United States Patent [19]

Schank et al.

[11] 4,371,600

[45] Feb. 1, 1983

[54] RELEASE OVERCOAT FOR PHOTORESPONSIVE DEVICE

[75] Inventors: Richard L. Schank, Webster; Dana G. Marsh, Rochester, both of N.Y.

[73] Assignee: Xerox Corporation, Stamford, Conn.

[21] Appl. No.: 278,512

[22] Filed: Jun. 26, 1981

[51] Int. Cl.[3] ..... G03G 5/04; G03G 5/07

[52] U.S. Cl. ..... 430/56; 430/58; 430/66; 430/126

[58] Field of Search ..... 430/66, 58, 57, 56; 427/387

[56] References Cited

U.S. PATENT DOCUMENTS

| | | | |
|---|---|---|---|
| 3,775,115 | 11/1973 | Sorkin et al. | 96/33 |
| 3,861,915 | 1/1975 | Cawley | 96/1.5 |
| 3,865,588 | 2/1975 | Ohto et al. | 96/33 |
| 3,886,865 | 6/1975 | Ohto et al. | 96/33 |
| 4,009,032 | 2/1977 | Schank | 96/33 |
| 4,181,772 | 1/1980 | Chu et al. | 430/58 |
| 4,251,612 | 2/1981 | Chu et al. | 430/58 |

*Primary Examiner*—John E. Kittle

*Assistant Examiner*—John L. Goodrow

*Attorney, Agent, or Firm*—E. O. Palazzo

[57] ABSTRACT

This invention relates to a release material and photoresponsive devices, especially layered devices, containing such material; the release material being comprised of a cross-linked siloxy coupled, dihydroxy polymer said cross-linked material being comprised of a silicone polymer of the following formula:

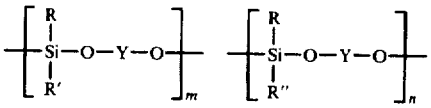

wherein R and R′ are independently selected from the group consisting of alkyl, substituted alkyl, aryl, and substituted aryl, R″ is selected from the group consisting of alkenes and substituted alkenes, Y is a dihydroxy radical, and m and n are numbers of sufficient value in order to result in a polymer having a molecular weight of from about 2,000 to about 250,000.

9 Claims, No Drawings

RELEASE OVERCOAT FOR PHOTORESPONSIVE DEVICE

BACKGROUND OF THE INVENTION

This invention is generally directed to an electrophotographic imaging device containing certain cross-linked siloxy polymers, and more specifically the present invention is directed to cross-linked siloxy polymer release materials, and photoresponsive devices, especially overcoated layered devices, containing such materials, which release materials allow the achievement of excellent release and transfer of toner images from such devices.

The formation and development of images utilizing photoresponsive devices is well known, one of the most widely used processes being xerography as described in U.S. Pat. No. 2,297,691. In these processes the electrostatic latent image is developed by applying toner particles thereto, and subsequently such developed image is transferred to a permanent substrate such as paper. Development can be accomplished by a number of various known techniques including cascade development, powder cloud development, magnetic brush development, liquid development, and the like.

Recently there has been developed for use in xerographic imaging systems, and for use in imaging systems utilizing a double charging process as explained hereinafter, overcoated organic imaging members including layered organic and layered inorganic photoresponsive devices. In one such photoreceptor device there is employed a substrate, overcoated with a hole injecting layer, which in turn is overcoated with a hole transport layer, followed by an overcoating of a hole generating layer, and an insulating organic resin overcoating as a top coating. These devices have been found to be very useful in various imaging systems, and have the advantage that high quality images are obtained, with the overcoating acting primarily as a protectant. The details of this type of overcoated photoreceptor are fully disclosed in U.S. Pat. No. 4,251,612, on Dielectric Overcoated Photoresponsive Imaging Member and Imaging Method, J. Y. C. Chu and S. Tutihasi, the disclosure of which is totally incorporated herein by reference.

In one preferred method of operation as described in the aforementioned patent, the photoreceptive member is charged a first time with electrostatic charges of negative charge polarity, subsequently charged a second time with electrostatic charges of a positive polarity, for the purpose of substantially neutralizing the charges residing on the electrically insulating surface of the member, followed by exposing the member to an imagewise pattern of activating electromagnetic radiation, thereby forming an electrostatic latent image. The image can then be developed to form a visible image, which is a transferred to a receiving member. The photoresponsive device may subsequently be reused to form additional reproductions after erasure and cleaning are accomplished.

When employing certain overcoated organic photoreceptors in an imaging system various problems have been encountered with regard to the development and transfer of the resulting developed image. Thus, for example, the toner materials do not release sufficiently from the photoresponsive surface leaving unwanted toner particles thereon, causing such particles to be subsequently embedded into, or transferred from the imaging surface in later imaging steps, thereby resulting in undesirable images of low quality and/or high background. Also in some instances the dry toner particles adhere to the imaging member in print background areas due to the adhesive attraction of the toner particles to the photoreceptor surface. This can be particularly troublesome when silicone resins, or elastomeric polymers are employed as overcoat materials for their melted toner release characteristics. Low molecular weight silicone components can migrate to the surface of the silicone polymer layer and act as an adhesive toward dry toner particles brought in contact therewith during the image development step in the imaging process, such as in the xerographic imaging process. There thus results undesirable high background prints, since the toner particles, along with the toner image, are efficiently transferred to the receiving sheet when simultaneous transfer and fixing is thermally accomplished.

SUMMARY OF THE INVENTION

It is an object of the present invention to provide an improved overcoated photoresponsive device which overcome the above-noted disadvantages.

A further object of the present invention is the provision of certain cross-linked siloxy coupled dihydroxy compounds, such as bisphenol-A, copolymers, which are useful for allowing the excellent release and transfer of toner particles from the imaging surfaces involved, when such silicone polymers are applied as coatings overcoated photoresponsive devices, such as layered overcoated devices.

A further object of the present invention is the provision of certain cross-linked siloxy coupled bisphenol-A copolymers and/or terpolymers of specific molecular weights, which when overcoated on photoresponsive devices, including disposable photoresponsive devices, prevents sticking of the toner particles to the photoresponsive layers.

A further object of the present invention is the provision of cross-linked siloxy coupled bisphenol-A copolymers or terpolymers, and overcoated photoresponsive devices containing such polymers, wherein fixing is simultaneously accomplished by heat and pressure, referred to herein as transfix.

These and other objects of the present invention are accomplished by the provision of certain cross-linked siloxy coupled dihydroxy compound, copolymers such as Bisphenol-A, copolymers, having a molecular weight of from about 2,000 to about 250,000, and preferably from about 40,000 to about 100,000, and photoresponsive devices, especially layered overcoated photoresponsive devices, containing such silicone polymers. More specifically, in one embodiment, the present invention is directed to a release material for use in an overcoated photoresponsive device for the purpose of allowing rapid release and transfer of toner particles from said device to a permanent substrate, the release material being comprised of a cross-linked siloxy coupled, dihydroxy polymer, said cross-linked material being comprised of a silicone polymer of the following formula:

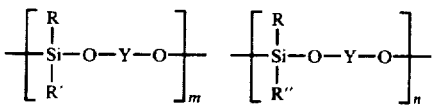

wherein R and R′ are independently selected from the group consisting of alkyl, substituted alkyl, aryl, and substituted aryl, R″ is selected from the group consisting of alkenes and substituted alkenes, Y is a dihydroxy radical, and m and n are numbers of sufficient value in order to result in a polymer having a molecular weight of from about 2,000 to about 250,000. In another embodiment the present invention is directed to a five layered overcoated photoresponsive device comprised of an electrically conductive substrate, overcoated with a layer capable of injecting holes into a layer on its surface, this layer being comprised of carbon black or graphite dispersed in a polymer, a hole transport layer in operative contact with the layer of hole injecting material, overcoated with a layer of charge generating material comprised of inorganic or organic photoconductive substances, this layer being in operative contact with the charge transport layer, a top layer of an insulating organic resin overlaying the layer of charge generating material, and contained in the top layer as a release material a cross-linked silicone polymer of the following formula:

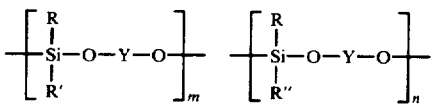

wherein R and R′ are independently selected from the group consisting of alkyl, substituted alkyl, aryl, and substituted aryl, R″ is selected from the group consisting of alkenes, and substituted alkenes, Y is a dihydroxy radical, and m and n are numbers of sufficient value in order to result in a polymer having a molecular weight of from about 2,000 to about 250,000.

In the above recited formulas, m is a number of from about 80 to about 99.9, and n is a number of from about 0.1 to about 20.

Materials which can be cross-linked and which are suitable for the present invention include siloxy linked copolymers or terpolymers referred to herein as silicone polymers, which are comprised of a copolymer or terpolymer of a siloxane and a dihydroxy compound, such silicone polymer being of the following formula:

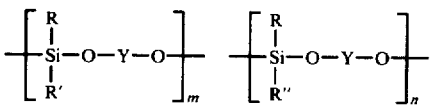

wherein R and R′ are independently selected from the group consisting of alkyl, substituted alkyl, aryl, and substituted aryl, R″ is selected from the group consisting of alkenes and substituted alkenes, Y is a dihydroxy radical, and m and n are numbers, as indicated herein of sufficient value in order to result in a polymer having a molecular weight of from about 2,000 to about 250,000.

Examples of alkyl radicals include, but are not limited to alkanes containing from about 1 to about 20 carbon atoms, and preferably from about 1 to about 10 carbon atoms, such as methyl, ethyl, propyl, butyl, isobutyl, n-butyl, pentyl, isopentyl, hexyl, heptyl, octyl, decyl, pentadecyl, eicosyl, and the like; while examples of alkenes include, but are not limited to those containing from 2 to about 24 carbon atoms, and preferably from 2 to about 10 carbon atoms, such as ethylene, propylene, butylene, pentylene, hexylene, heptylene, octylene, decylene, pendadecylene, eicosylene, and the like. The aryl radicals include but are not limited to those containing from about 6 to about 20 carbon atoms, such as phenyl, naphthyl, anthryl, and the like. The aforementioned radicals can contain various different substituents including but not limited to halogen, such as chloride, bromide, fluoride, and iodide; alkyl, as defined herein, and the like.

The dihydroxy radical Y includes but is not limited to those radicals containing at least two hydroxyl groups, such as those derived from ethylene glycol, butylene glycol, propylene glycol, isopropylene glycol, trimethylene glycol, 1,3-butane diol, pentamethylene glycol, hexamethylene glycol glycerol, biphenols and the like, with biphenols being preferred. Examples of biphenols include 2,2-bis-(4-hydroxy phenyl)-propane (bisphenol A), 2,4′-dihydroxydiphenyl-methane; bis-(2-hydroxyl-phenyl)-methane; bis-(4-hydroxyphenyl)-methane; bis-(4-hydroxy-5-nitrophenyl)-methane; bis-(4-hydroxy-2,6-dimethyl-3-methoxyphenyl)-methane; 1,1-bis-(4-hydroxyphenyl)-ethane; 1,2-bis-(4-hydroxyphenyl)-ethane; 1,1-bis-(4-hydroxy-2-chlorophenyl)-ethane; 1,1-bis-(2,5-dimethyl-4-hydroxyphenyl)-ethane; 1,3-bis-(3-methyl-4-hydroxyphenyl)propane; 2,2-bis-(3-isopropyl-4-hydroxyphenyl)-propane; 2,2-bis-(4-hydroxynaphthyl)-propane; 2,2-bis-(4-hydroxyphenyl)-pentane; 3,3-bis-(4-hydroxyphenyl)-pentane; 2,2-bis-(4-hydroxyphenyl)-heptane; bis-(4-hydroxy-phenyl)-phenyl methane; bis-(4-hydroxy-phenyl)-cyclohexyl methane; 1,2-bis-(4-hydroxyphenyl)-1,3-bis(phenyl)ethane; 2,2-bis-(hydroxyphenyl)-1,3-bis-(phenyl) propane; 2,2-bis(4-hydroxyphenyl)-1-phenyl propane; and the like.

Illustrative examples of silane materials that can be used as one of the reactants for causing the formation of the silicone polymer, which polymer is subsequently cross-linked, include for example dimethyl dichloro silane, methyl phenyl dichloro silane, diphenyl dichloro silane, methyl dichloro silane, dibutyl dichloro silane, dimethyl dibromo silane, methyl octyl dichloro silane, methyl octyl dibromo silane, methyl vinyl dichlorosilane, methylallyldichlorosilane, bis-dimethyl amino dimethyl silane and the like. The preferred silanes utilized as reactants include dimethyl dichlorosilane, methylphenyldichlorosilane, and methylvinyldichlorosilane.

Illustrative examples of specific silicone polymers of the present invention include dimethylsiloxy coupled bisphenol A, methyloctyl siloxy coupled bisphenol A, methylphenyl siloxy coupled bisphenol A, dimethyl siloxy coupled 2,4′-dihydroxydiphenyl-methane, dimethyl siloxy coupled bis(2-hydroxy phenyl) methane, dimethyl siloxy coupled 1,2-bis-(4-hydroxy phenyl)-ethane, methyl octyl siloxy coupled bis-(2-hydroxy phenyl)-methane, methyloctyl siloxy coupled 2,4′-dihydroxy diphenylmethane, methyl octyl siloxy coupled bis(4-hydroxy phenyl)-methane, methoctyl-siloxy coupled 1,1-bis-(4-hydroxy phenyl) ethane, methyloctyl siloxy coupled 1,3-bis-(4-hydroxyphenyl)-ethane, methyloctyl siloxy coupled, 2,2-bis-(3-phenyl-4-hydroxy phenyl)propane, methyloctyl siloxy coupled 2,2-bis-(4-hydroxy phenyl) pentane, dimethylsiloxy-bisphenol-A/methylvinylsiloxy-bisphenol-A; methylphenyl-siloxy-bisphenol-A/methylvinylsiloxy-bisphenol-A; dimethylsiloxy-bisphenol-A/methyl-allyl siloxy-bisphenol-A; methylphenylsiloxy-bisphenol-A/methylallysiloxy-bisphenol-A; -diethylsiloxy-bisphenol-A/methylvinylsiloxy-bisphenol-A; methyloctylsiloxy-bisphenol-A/methylvinylsiloxy-bisphenol-A; and the like.

One possible crosslinking mechanism that can be employed for forming the cross-linked silicone polymers of the present invention involves the addition of a reactive hydrogen or silicon, present in a cross-linking additive, to a vinyl group on silicon, in some predetermined concentration, in the siloxy coupled bisphenol-A polymer chains as illustrated below:

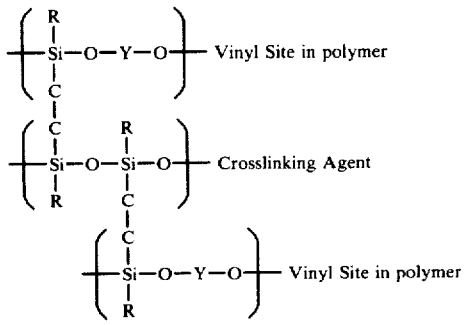

The silicone polymers are cross-linked in accordance with prior art techniques which generally involves adding to the silicone polymer described herein a cross-linking agent, such as a silanic hydrogen cross-linking fluid available from Union Carbide as L-31 or other cross-linking agents such as tetramethyldisiloxane; 1,3,5,7-tetramethylcyclotetrasiloxane, and the like. More specifically, the cross-linking reaction is accomplished by blending the appropriate silicone polymer solution containing a predetermined concentration of reactive sites on silicon, as for example vinyl, with a silicon hydrogen cross-linking agent such as Union Carbide L-31 described herein, and sufficient catalyst such as chloroplatinic acid for example, to accomplish the addition reaction. The amount of cross-linking agent employed can range from well below the stoichiometric concentration to a slight excess depending upon the degree of cross-linking desired. After application and solvent evaporation the polymer film can be cured (cross-linked) at room temperature over an extended period of time or can be heated to relatively moderate temperatures, that is, from 40° C. to about 120° C., to accomplish the reaction in only a few minutes.

With regard to the silicon terpolymer employed which is subsequently cross-linked in one embodiment this material is generally prepared by reacting the appropriate silanes with a suitable biphenol such as bisphenol A in a flask under agitation. In one preferred method of preparation, a biphenol such as bisphenol A is heated in a Morton flask under agitation at a temperature of about 25° C. with suitable solvents such as benzene and pyridine, until the bisphenol A has been dissolved. Subsequently the appropriate silanes such as dichlorosilanes are added to the dissolved mixture over a period of about 1 to 2 hours, and at a temperature of from about 40° C. to about 60° C. This reaction mixture is then heated to insure completness and subsequently cooled to room temperature. Thereafter the pyridine hydrochloride is removed by filtration or dissolved in water and removed. The polymer solution is washed of contaminants and the polymer isolated by vacuum evaporation of the solvent. The polymer can then be heated at elevated temperatures for a period of about 5–20 hours in a vacuum in order to complete the condensation reaction, if necessary.

The cross-linked silicone polymers of the present invention are generally applied to the overcoating layer of a layered photoresponsive device such as described herein. However, there can also be utilized as one preferred overcoated photoresponsive device, one comprised of a polypropylene, Mylar, or aluminized Mylar, substrate overcoated with a generating layer containing either pyrylium dyes or vanadyl phthalocyanine, overcoated with a transport layer comprised of certain diamines as described hereinafter, in a top overcoating of a polycarbonate, particularly the polycarbonate commercially available as Lexan. With such a photoreceptor the polymer of the present invention is applied by known prior art methods to the top coating of the photoresponsive device, which methods include blade coating, dip or flow coating or spraying using a suitable solvent or solvent mixture so as to form the desired overcoat film thickness without adversely affecting the polycarbonate substrate. Solvent mixtures containing, as for example, high concentrations of cyclohexane (80–90%), a non-solvent for polycarbonate, can be employed with excellent results. Typically the copolymer is applied in amounts of from about 2.0 percent to about 5.0 percent solids so as to result in a uniform coating of such polymer on the polycarbonate overcoating in a thickness of from about 0.1 microns to about 1.0 micron.

The cross-linked polymers of the present invention can also be applied to other photoresponsive devices particularly as the overcoating layer for accomplishing release and transfer of the toner particles. Illustrative examples of such other devices include conventional photoreceptors like selenium, and those comprised of a substrate, a hole injecting electrode material in contact with the substrate, a charge transport layer comprised of an electrically inactive organic resin having dispersed therein an electrically active material, the combination of which is substantially non-absorbing to visible electromagnetic radiation but which allows the injection of photogenerated holes from a charge generating layer in contact therewith, and a layer of insulating organic resin overlaying the layer of charge generating material.

Examples of materials for one photoresponsive device that can be treated with the polymers of the present invention include the following illustrative layers:

The substrate can be opaque or substantially transparent and may comprise non-conducting materials such as inorganic or organic polymeric materials; a layer of an organic or inorganic material having a conductive surface layer arranged thereon, such as aluminized Mylar, or a conductive material such as aluminum, brass or the like. The substrate is generally flexible, however, it may also be rigid and can assume many different configurations such as a plate, a cylindrical drum, an endless belt, and the like. The thickness of the substrate layer can be over 100 mils, but is preferably from about 3 to 10 mils. The hole injecting electrode layer coated over the substrate can include many materials which are capable of injecting charge carriers under the influence of an electrical field, and include for example gold, graphite, and preferably carbon black or graphite dispersed in various polymer resins, this electrode being prepared by solution casting of a mixture of carbon black or graphite dispersed in an adhesive polymer solution onto a support substrate such as Mylar or aluminized Myler. Illustrative examples of polymers that can be used as the material within which the carbon black or graphite is dispersed include polyesters such as PE-100 commercially available from Goodyear Company, as well as those polyester materials that are polymeric esterification products of a dicarboxylic acid and a diol comprising a diphenol such as 2,2-bis(4-beta hydroxy ethoxy phenyl) propane, 2,2-bis(4-hydroxyisoepoxyphenyl) propane, 2,2-bis(4-beta hydroxy ethoxy phenyl) pentane and the like, while typical dicarboxylic acids include oxalic acid, malonic acid, succinic acid, phthalic acid, terephthalic acid, and the like. The ratio of polymer to carbon black or graphite ranges from about 0.5:1 to 2:1 with the preferred range of about 6:5. The hole injecting layer has a thickness in the range of from about 1 to about 20 microns or preferably from about 4 to about 10 microns.

The charge carrier transport layer which is overcoated on the hole injecting material can be any number of numerous suitable materials which are capable of transporting holes, this layer generally having a thickness in the range of from about 5 to about 50 microns and preferably from about 20 to about 40 microns. This transport layer comprises molecules of the formula:

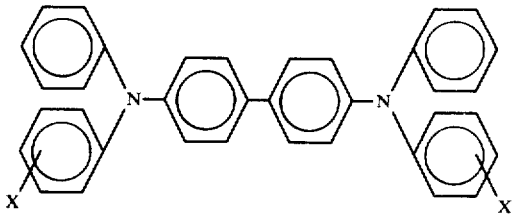

dispersed in a highly insulating and transparent organic resinous material wherein X is selected from the group consisting of (ortho) $CH_3$, (meta) $CH_3$, (para) $CH_3$, (ortho) Cl, (meta) Cl, (para) Cl. The charge transport layer is substantially non-absorbing in the spectral region of intended use, i.e., visible light, but is "active" in that it allows injection of photogenerated holes from the charge generator layer and electrically induced holes from the injecting interface. The highly insulating resin, which has a resistivity of at least $10^{12}$ ohm-cm to prevent undue dark decay, is a material which is not necessarily capable of supporting the injection of holes from the injecting or generator layer and is not capable of allowing the transport of these holes through the material. However, the resin becomes electrically active when it contains from about 10 to 75 weight percent of the substituted N,N,N',N'-tetraphenyl-[1,1'-biphenyl]4-4'-diamines corresponding to the foregoing formula. Compounds corresponding to this formula include, for example, N,N'-diphenyl-N,N'-bis-(alkylphenyl)-[1,1-biphenyl]-4,4'-diamine wherein the alkyl is selected from the group consisting of methyl such as 2-methyl, 3-methyl and 4-methyl, ethyl, propyl, butyl, hexyl and the like. In the case of chloro substitution, the compound is named N,N'-diphenyl-N,N'-bis(halo phenyl)-[1,1'-biphenyl]-4,4'-diamine wherein the halo atom is 2-chloro, 2-chloro or 4-chloro.

Other electrically active small molecules which can be dispersed in the electrically inactive resin to form a layer which will transport holes include triphenylmethane, bis-(4-diethylamino-2-methylphenyl)phenylmethane; 4',4''-bis(diethylamino)-2',2''-dimethyltriphenyl methane; bis-4(-diethylamino phenyl)phenylmethane; and 4,4'-bis(diethylamine)-2',2''-dimethyltriphenylmethane.

The generating layer, in addition to those disclosed herein, for example, pyrylium dyes, includes for example, numerous photoconductive charge carrier generating materials provided they are electronically compatible with the charge carrier transport layer, that is, they can inject photoexcited charge carriers into the transport layer and charge carriers can travel in both directions across the interface between the two layers. Particular photoconductive charge carrier generating materials include amorphous and trigonal selenium, selenium-arsenic and selenium-tellurium alloys and organic charge carrier generating materials such as phthalocyanines like metal free, for example, the X-form of phthalocyanine, or metal phthalocyanines including vanadyl phthalocyanine. These materials can be used alone or as a dispersion in a polymeric binder. This layer is typically from about 0.5 to about 10 microns or more in thickness. Generally, it is desired to provide this layer in a thickness which is sufficient to absorb at least 90 percent (or more) of the incident radiation which is directed upon it in the imagewise exposure step. The maximum thickness is dependent primarily on factors such as mechanical considerations, e.g., whether a flexible photoreceptor is desired.

The electrically insulating overcoating layer typically has a bulk resistivity of from about $10^{12}$ to about $5\times10^{14}$ ohm-cm and typically is from about 5 to about 25 microns in thickness. Generally, this layer provides a protective function in that the charge carrier generating layer is kept from being contacted by toner and ozone which is generated during the imaging cycles. The overcoating layer also must prevent charges from penetrating through it into charge carrier generating layer or from being injected into it by the latter. Preferably, therefore insulating overcoating layer comprises materials having higher bulk resistivities. Generally, the minimum thickness of the layer in any instance is determined by the functions the layer must provide whereas the maximum thickness is determined by mechanical considerations and the resolution capability desired for the photoreceptor. Typical suitable materials include Mylar (a polyethylene terephthalate film available from E. I. duPont de Nemours), polyethylenes, polycarbonates, polystyrenes, polyesters, polyurethanes and the like.

The photoresponsive device useful in the present invention can also be comprised of a substrate, overcoated with a transport layer as described herein, which in turn is overcoated with a generating layer described herein.

In one imaging sequence the five layered overcoated photoresponsive device described hereinbefore, is electrically charged negatively a first time in the absence of illumination, the negative charges residing on the surface of the electrically insulating overcoating layer. In view of this, an electric field is established across the photoreceptor and as a result of this field holes are injected from the charge carrier injecting electrode layer into the charge carrier transport layer which holes are transported through the layer and enter into the charge carrier generating layer. These holes travel through the generating layer until they reach the interface between the charge carrier generator layer and the electrically insulating overcoating layer where such charges become trapped and as a result of this trapping at the interface there is established an electrical field across the electrically insulating overcoating layer. Generally this charging step is accomplished with a voltage in the range of from about 10 volts/microns to about 100 volts/microns.

Subsequently, the device is charged a second time in the absence of illumination but with a polarity opposite to that used in the first charging step thereby substantially neutralizing the charges residing on the surface. After the second charging step with a positive polarity the surface is substantially free of electrical charges, that is the voltage across the photoreceptor member upon illumination of the photoreceptor may be brought to substantially zero. As a result of the second charging step, positive charges reside at the interface between the generating layer and the overcoating layer and further there is a uniform layer of negative charges located at the interface between the hole injecting layer and the transport layer.

Thereafter, the photoreceptor member can be exposed to an imagewise pattern of electromagnetic radiation to which the charge carrier generating material namely the pigment dispersed in the silicone polymer of the present invention, is responsive and as a result of such imagewise exposure an electrostatic latent image is formed on the photoreceptor. The electrostatic image formed may then be developed by conventional means resulting in a visible image such development being accomplished by for example, cascade, magnetic brush, liquid development, and the like. The visible image is typically transferred to a receiver member by an conventional transfer techniques, and permanently affixed thereto.

The invention will now be described in detail with respect to specific preferred embodiments thereof, it being understood that these examples are intended to be illustrative only and the invention is not intended to be limited to the materials, conditions, process parameters and the like recited herein. Parts and percentages are by weight unless otherwise indicated.

EXAMPLE I

There was prepared a dimethylsiloxy-bisphenol-A/methylvinylsiloxy-bisphenol-A polymer by the following method: Into a 500 ml, 3-necked Morton flask equipped with a mechanical stirrer, reflux condenser, dropping funnel, thermometer and electric heating mantle was added 22.8 grams (0.10 moles) of bisphenol-A, 20.0 grams of dry pyridine and 50 ml. of dry toluene. The mixture was stirred at room temperature until the bisphenol-A dissolved, heated to 50°-60° C. and subsequently a mixture of 12.3 grams (0.095 moles) of dimethyldichlorosilane and 1.4 grams (0.010 moles) of methylvinyldichlorosilane were added dropwise into the flask over a period of 45 minutes and at a temperature of 55°-60° C. The reaction mixture was then stirred an additional 15 minutes at 55°-60° C., subsequently cooled to room temperature, followed by the addition of 100 ml of toluene. This was followed by the addition of 200 ml. of water to dissolve the pyridine hydrochloride. The entire reaction mixture was transferred to a separatory funnel where the salt water layer was removed. The crude polymer in toluene was washed with two 200 ml. portions of a 2 percent solution of HCl, two 200 ml. portions of a 2 percent solution of sodium bicarbonate and finally with distilled water to a neutral pH. The polymer layer was separated, dried over $Na_2SO_4$ and filtered. The solvent can be removed by stripping or the polymer can be isolated by precipitation into n-hexane.

EXAMPLE II

In order to determine the effectiveness of the silicone polymer of the present invention, the following was accomplished.

To an uncharged, uncoated homogeneous photoreceptor device containing an aluminized Mylar substrate of a thickness of 2.0 microns, coated with the polycarbonate polymer LEXAN, which is commercially available, containing therein a photogenerating thiapyrlium dye, and the transport material N,N'-diphenyl-N,N'-bis-(methylphenyl)-[1,1-biphenyl]-4,4'-diamine, this layer having a thickness of 10.0 microns, there was applied a toner composition comprised of a styrene n-butylmethacrylate copolymer containing 65 percent by weight of styrene and 35 percent by weight of n-butylmethacrylate. The toner was then removed by snapping the photoresponsive device and no residual toner was observed.

The above procedure was repeated with the exception that there was utilized a segment of the photoresponsive device coated with 0.1 to 0.2 microns of a cross-linked silicone release surface material commercially available from Dow Corning as R-4-3117. Residual toner adhered to the silicone surface as determined from visual observation.

The above procedure was again repeated a third time utilizing a segment of the above-identified photoresponsive device coated with a film of 0.1 to 0.2 microns of the cross-linked dimethylsiloxy-bisphenol-A, methylvinylsiloxy/bisphenol-A polymer of Example I and no residual toner was observed indicating that this polymer had better dry toner release properties than, for example, the commercially available silicone release surface material, Dow Corning R-4-3117.

EXAMPLE III

The photoresponsive device of Example II was coated with the dimethylsiloxy-bisphenol-A-methylvinylsiloxy-bisphenol-A polymer of Example I, the polymer mixture being in toluene, and also containing a silanic hydrogen cross-linking fluid commercially available from Union Carbide as Union Carbide L-31 and about 500 parts per million of platinum as chloroplatinic acid. The photoreceptor was allowed to dry for a period of about 1-3 hours and then subsequently it was exposed to heat at a temperature of 50°-70° C. for 7-10 minutes for the purpose of facilitating the cross-linking reaction of the polymer. There resulted a film at a thickness of 0.1 to 0.2 microns.

There was then applied to the photoresponsive device containing the above film a toner composition comprised of 60 percent magnetite and 40 percent of a styrene n-butylmethacrylate copolymer resin containing 65 percent by weight of styrene and 35 percent by weight of n-butylmethacrylate. The photoresponsive device sample was then placed on a hot plate surface maintained at a temperature of 120° C. and a sheet of paper was placed into contact with this surface followed by the application of pressure by utilization of rollers. The paper was then pealed from the photoresponsive surface sample and excellent transfer of toner, almost 100 percent to the paper, was noted by visual observation. The overcoated photoresponsive release film remained in tact and resided on the polycarbonate surface indicating both excellent adhesion to the polycarbonate and cross-linking since the film was not removed by exposure to a temperature of 120° C.

EXAMPLE IV

The photoresponsive device of Example II was coated with a methylphenylsiloxy-bisphenol-A-methylvinylsiloxy-bisphenol-A polymer as prepared in Example I, the polymer mixture also containing the crosslinking fluid described in Example III and about 500 parts per million of platinum as chloroplatimic acid in toluene solvent. The photoreceptor was allowed to air dry about one hour and heated at 85° C. for 3–5 minutes for the purpose of facilitating the crosslinking reaction. A film of about 0.1 to 0.2 microns resulted.

The toner composition of Example III was applied to the above film, heated and transferred to paper as described in Example III with substantially identical results.

Although the invention has been described with respect to specific preferred embodiments, it is not intended to be limited thereto, but rather those skilled in the art will recognize that variations and modifications may be made therein which are within the spirit of the invention and the scope of the claims.

What is claimed is:

1. An overcoated photoresponsive device comprised of a substrate, overcoated with a transport layer, which in turn is overcoated with a photogenerating layer containing therein as a release material a cross-linked silicone polymer of the formula:

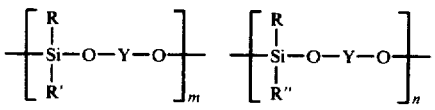

wherein R and R′ are independently selected from the group consisting of alkyl, substituted alkyl, aryl, and substituted aryl, R″ is selected from the group consisting of alkenes and substituted alkenes, Y is a dihydroxy radical, and m and n are numbers of sufficient value so as to result in a polymer having a molecular weight of from about 2,000 to about 250,000.

2. An overcoated photoresponsive device in accordance with claim 1, wherein the substrate is overcoated with a photogenerating layer, and the photogenerating layer in turn is overcoated with a transport layer.

3. An overcoated photoresponsive device in accordance with claims 1 or 2, wherein the photogenerating layer is comprised of selenium.

4. An overcoated photoresponsive device in accordance with claim 2, wherein the photogenerating layer is comprised of trigonal selenium.

5. An overcoated photoresponsive device in accordance with claims 1 or 2, wherein the photogenerating layer is comprised of metal free phthalocyanines or methal phthalocyanines.

6. An overcoated photoresponsive device in accordance with claims 1 or 2, wherein the photogenerating layer is comprised of vanadyl phthalocyanine.

7. An overcoated photoresponsive device in accordance with claims 1 or 2, wherein the charge transport layer is comprised of molecules of the formula;

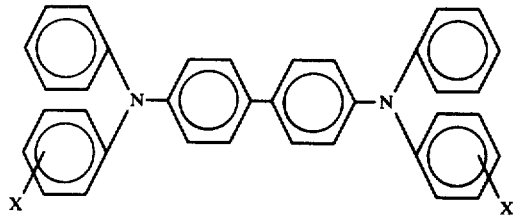

dispersed in a highly insulating and transparent organic resinous material, wherein X is selected from the group consisting of (ortho) $CH_3$, (meta) $CH_3$, (para) $CH_3$, (ortho) Cl, (meta) Cl, and (para) Cl.

8. An overcoated photoresponsive device in accordance with claims 1 or 2, wherein the transport molecule is N,N′-diphenyl-N,N′-bis-(methylphenyl)-[1,1-biphenyl]-4,4′-diamine.

9. An overcoated photoresponsive device in accordance with claims 1 or 2, wherein the silicone polymer is a cross-linked dimethylsiloxy-bisphenyl-A/methylvinylsiloxy-bisphenol-A polymer, methylphenolsiloxy-bisphenol-A/methylvinylsiloxy-bisphenol-A polymer, dimethylsiloxy-bisphenol-A/methylallylsiloxy-bisphenol-A polymer, methylphenolsiloxy-bisphenol-A/methylallylsiloxy-bisphenol-A polymer, diethylsiloxy-bisphenol-A/methylvinylsiloxy-bisphenol-A polymer, or methyloctylsiloxy-bisphenol-A/methylvinylsiloxy-bisphenol-A polymer.

* * * * *